US011069316B2

(12) United States Patent
Li

(10) Patent No.: US 11,069,316 B2
(45) Date of Patent: Jul. 20, 2021

(54) LIQUID CRYSTAL DISPLAY, DRIVING CIRCUIT AND DRIVING METHOD FOR THE LIQUID CRYSTAL DISPLAY

(71) Applicants: HKC CORPORATION LIMITED, Shenzhen (CN); CHONGQING HKC OPTOELECTRONICS TECHNOLOGY CO., LTD., Chongqing (CN)

(72) Inventor: Zeyao Li, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/954,304

(22) PCT Filed: Sep. 11, 2018

(86) PCT No.: PCT/CN2018/105063
§ 371 (c)(1),
(2) Date: Jun. 16, 2020

(87) PCT Pub. No.: WO2019/119890
PCT Pub. Date: Jun. 27, 2019

(65) Prior Publication Data

US 2021/0142750 A1 May 13, 2021

(30) Foreign Application Priority Data

Dec. 21, 2017 (CN) ..... 201711392829.0

(51) Int. Cl.
*G09G 3/36* (2006.01)

(52) U.S. Cl.
CPC ..... *G09G 3/3648* (2013.01); *G09G 3/3674* (2013.01); *G09G 3/3685* (2013.01);
(Continued)

(58) Field of Classification Search
None
See application file for complete search history.

(56) References Cited

U.S. PATENT DOCUMENTS

2007/0046567 A1* 3/2007 Ha ..... G09G 3/3648 345/38
2012/0026206 A1* 2/2012 Moon ..... G09G 3/3614 345/690
2016/0005767 A1* 1/2016 Shen ..... G02F 1/1368 257/72

FOREIGN PATENT DOCUMENTS

CN 101308271 A 11/2008
CN 102073180 A 5/2011
(Continued)

OTHER PUBLICATIONS

International Search Report in corresponding PCT Application PCT/CN2018/105063, dated Nov. 30, 2018.

*Primary Examiner* — Christopher J Kohlman
(74) *Attorney, Agent, or Firm* — Westbridge IP LLC

(57) ABSTRACT

A driving circuit, which includes: a plurality of pixel units arranged in a matrix; at least one scan line, the pixel units in two adjacent rows share one scan line, the scan line inputs a first driving voltage to the pixel units in row i, and inputs a second driving voltage to the pixel units in row i+1, and the first driving voltage and the second driving voltage have reverse polarities; at least one data line, and each data line connects the pixel units in a corresponding column; a controller, connected to the scan line and the data line
(Continued)

simultaneously and configured to control timing outputs of the scan line and the data line.

5 Claims, 5 Drawing Sheets

(52) U.S. Cl.
CPC ..... *G09G 2300/0426* (2013.01); *G09G 2300/0439* (2013.01); *G09G 2310/08* (2013.01)

(56) References Cited

FOREIGN PATENT DOCUMENTS

| | | | |
|---|---|---|---|
| CN | 103792746 | A | 5/2014 |
| CN | 107945757 | A | 4/2018 |
| CN | 207742919 | U | 8/2018 |

* cited by examiner

LIQUID CRYSTAL DISPLAY, DRIVING CIRCUIT AND DRIVING METHOD FOR THE LIQUID CRYSTAL DISPLAY

FIELD

The present disclosure generally relates to the technical field of liquid crystal display, and more particularly relates to improvements to a driving circuit of a liquid crystal display device.

BACKGROUND

Currently, liquid crystal displays (LCD) have the properties of low power consumption, low radiation, small volume, and soft image, thus the liquid crystal displays are widely used in display screens for televisions, mobile phones, and public information display.

The image quality of the liquid crystal display is the chief factor for product success, while resolution ratio and brightness are two important parameters among the numerous parameters which determine the image quality.

In an exemplary technique, a driving circuit of the liquid crystal display includes components of a scan line, a data line, a thin film transistor, a pixel electrode, and a common electrode wiring, etc. However, people's demands for display quality, especially the resolution ratio, are further improved, and the inherent structures on array substrates also need to be modified. For example, it needs to increase the quantities or volumes of the components, such as the scan line, the data line, the thin film transistor, and the common electrode wiring, as such the components would take up more and more space, thereby causing that there only remains a smaller space for placing the pixel electrode, as a result, an aperture ratio of a pixel area is decreased, and light transmittance is reduced, the display brightness of the liquid crystal display device is further affected.

Therefore, people urgently look for solutions of how to improve the aperture ratio of the liquid crystal display device having high resolution ratio, and how to improve the display brightness.

SUMMARY

In order to solve the above problem, the exemplary embodiment of the present disclosure provides a driving circuit, which includes:

a plurality of pixel units arranged in matrix; at least one scan line, the pixel units in two adjacent rows shares one scan line, the scan line inputs a first driving voltage to the pixel units in low i, and inputs a second driving voltage to the pixel units in row i+1, the first driving voltage and the second driving voltage have reverse polarities; at least one data line, each data line connects the pixel units in a corresponding column; a controller, connected to the scan line and the data line simultaneously, and configured to control timing outputs of the scan line and the data line.

The another exemplary embodiment of the present disclosure further provides a liquid crystal display, which includes: an array substrate, a color filter substrate facing the array substrate, and a liquid crystal layer defined between the array substrate and the color film substrate, the array substrate includes: at least one scan line; at least one data line, crossed with the scan line; a first pixel unit, defined at the intersection of the data line and the scan line, the first pixel unit includes a first pixel electrode and a first switch component, the first pixel electrode connects to the data line and the scan line through the first switch component; and a second pixel unit, defined at the intersection of the data line and the scan line, the second pixel unit includes a second pixel electrode and a second switch component, the second pixel electrode connects to the data line and the scan line through the second switch component, the second pixel unit and the first pixel unit are located at two adjacent rows and share one scan line, the first switch component and the second switch component have opposite switch states.

The present disclosure further provides a driving method for driving circuit, which includes: a plurality of pixel units arranged in matrix; at least one scan line, the pixel units in two adjacent rows shares one scan line, the scan line inputs a first driving voltage to the pixel units in low i, and inputs a second driving voltage to the pixel units in row i+1, the first driving voltage and the second driving voltage have reverse polarities; at least one data line, each data line connects the pixel units in a corresponding column; a controller, connected to the scan line and the data line simultaneously, and configured to control timing outputs of the scan line and the data line;

under the control of the control unit, the scan line s(i) is enabled to input a positive polarity high voltage to the pixel units in row i at a first moment, to achieve the conducting of the pixel units in row i and remain the pixel units in row i+1 non-conducting, and the data line D(j) is enabled to charge the pixel units in column j, allowing the pixel unit in row i and in column j to acquire charge information; and under the control of the control unit, the scan line s(i) is enabled to input a negative polarity low voltage to the pixel units in row i+1 at a second moment, to achieve the conducting of the pixel units in row i+1 and remain the pixel units in row i non-conducting, and the data line D(j) is enabled to charge the pixel units in column j, allowing the pixel unit in row i+1 and in column j to acquire charge information; the i, j are positive integers.

The present disclosure further provides another driving circuit, which includes: a plurality of pixel units arranged in matrix; at least one scan line, the pixel units in two adjacent rows sharing one scan line, the scan line inputting a first driving voltage to the pixel units in low i, and inputting a second driving voltage to the pixel units in row i+1, the first driving voltage and the second driving voltage having reverse polarities, the switch component of the pixel units in row i is an n-type thin film transistor, the switch component of the pixel units in row i+1 is a p-type thin film transistor; at least one data line, each data line connects the pixel units in a corresponding column; a controller, connected to the scan line and the data line simultaneously, and configured to control timing outputs of the scan line and the data line.

For the driving circuit of the exemplary embodiment, the switch components of the pixel units in two adjacent rows have different types, and the driving voltages of the above switch components also have reverse polarities. The pixel units in two adjacent rows can be controlled by controlling the nature of the input driving voltage of one scan line. Therefore, the quantity and occupied space of the scan lines are greatly reduced, and there would remain much more space for the pixel units, and the aperture ratio is also increased. At the condition of the same resolution, the brightness of the present disclosure is effectively improved.

DETAILED DESCRIPTION

The present disclosure will be clearly and completely described in the following, with reference to the exemplary embodiments.

The exemplary embodiment provides a driving circuit applied in liquid crystal display, the driving circuit can greatly reduce the quantity and occupied space of the scan lines, and improve the aperture ratio of the pixel units.

Figure 1A:
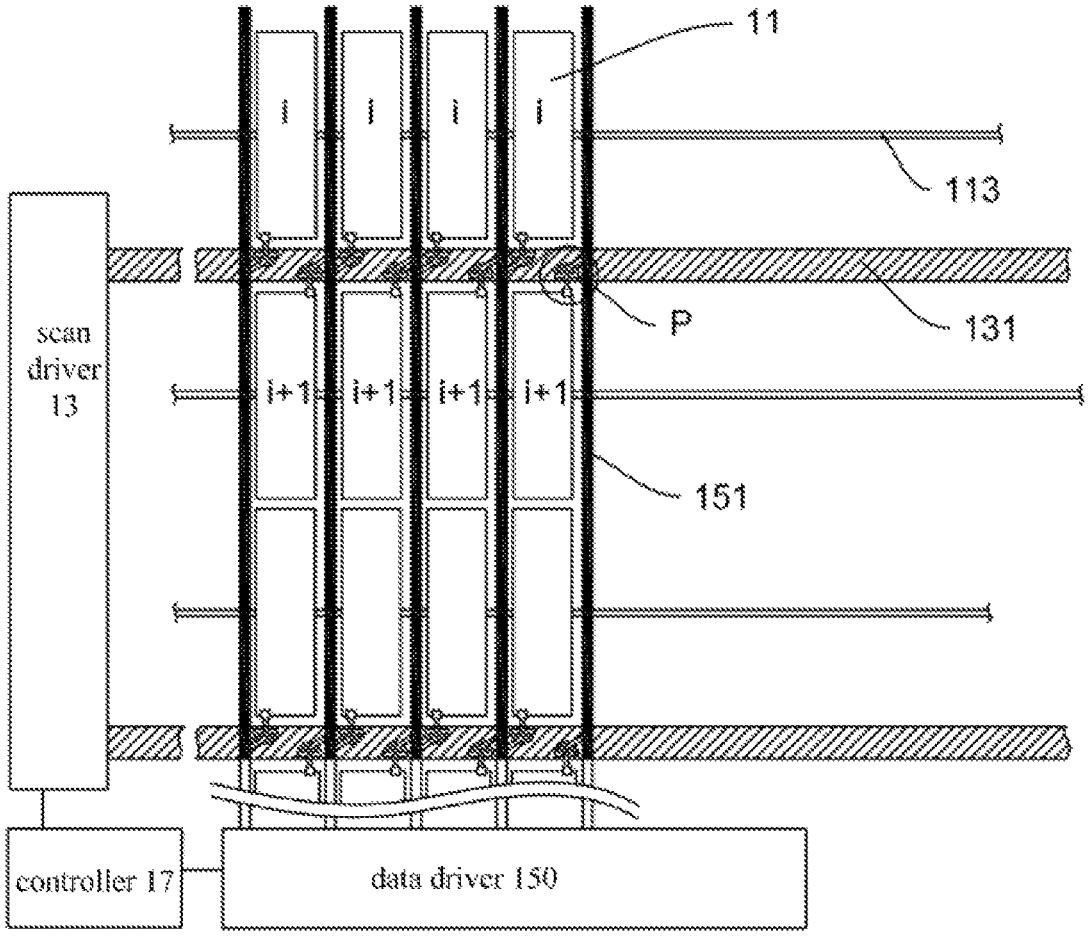
FIG. 1*a* is a structure diagram of the driving circuit of the present disclosure according to an exemplary embodiment.

Referring to FIG. 1*a*, the driving circuit 10 includes: a plurality of pixel units 11 arranged in matrix; a scan line 131, a data line 151, and a controller 17. The scan line 131 is crossed with the data line 151, the pixel unit 11 is defined at the intersection of the data line 151 and the scan line 131.

The driving circuit 10 of the array substrate (not shown) is internally provided with a plurality of scan lines 131, for example, all the scan lines 131 can be connected to a scan driver 13 to acquire the driving voltage provided by the scan driver 13. For example, the controller 17 may connect to the scan line 131 through the scan driver 13, the scan driver 13 can input a driving voltage with a preset polarity to the scan line 131 at a preset moment.

In the exemplary embodiment, the pixel units 11 in two adjacent rows share one scan line 131, that is, the pixel units 11 in row i (such as, a row in odd rows), and the pixel units 11 in row i+1 (such as, a row in even rows) are respectively located at two sides of one scan line 131, and connect to the scan line 131 simultaneously. The scan line 131 respectively input a first driving voltage V1 to the pixel units 11 in row i, and input a second driving voltage V2 to the pixel units 11 in row i+1, the first driving voltage V1 and the second driving voltage V2 have reverse polarities, the scan line 131 can input different driving voltages at different times, i is a positive integer.

Similarly, the driving circuit 10 of the array substrate (not shown) is provided with a plurality of data lines 151, for example, the data lines 151 connect to one data driver 15 to acquire the charge information provided by the data driver 15. Each data line 151 connects the pixel units 11 in a corresponding column. For example, the pixel units 11 in the same column may be connected to one same data line 151 alternately and respectively, or the pixel units 11 may also be connected to the same side of the same data line 151. The controller 17 can be connected with the data line 151 through the data driver 15, and input preset charge information to the data line 151 through the data driver 15 at the preset moment.

The controller 17 is connected to the scan line driver 13 and the data line driver 15 to control timing outputs of the scan line driver 13 and the data line driver 15.

Figure 1B:
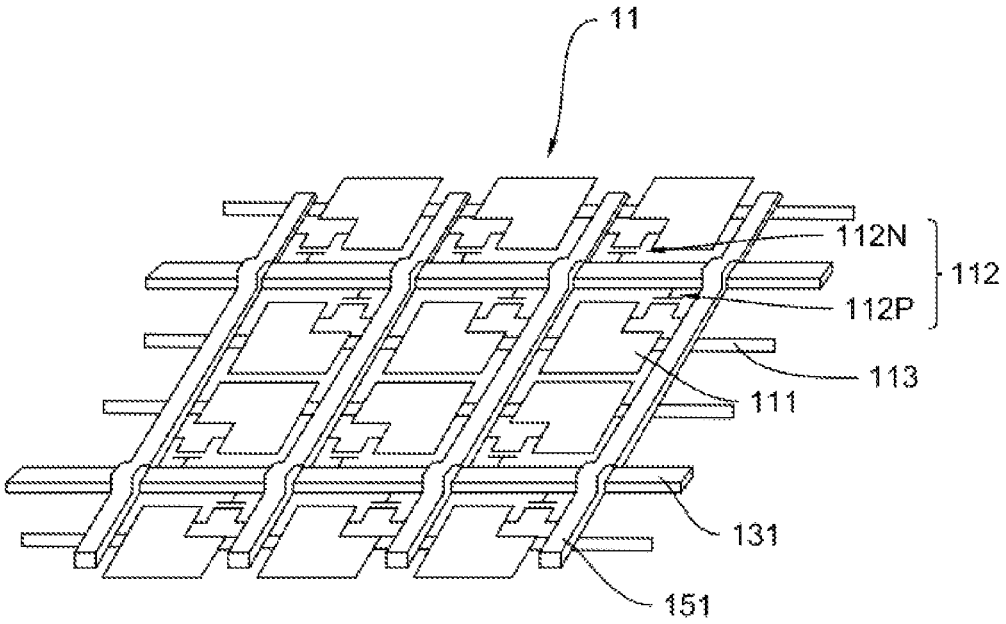
FIG. 1*b* is another structure diagram of the driving circuit of the present disclosure according to an exemplary embodiment.
Figure 1C:
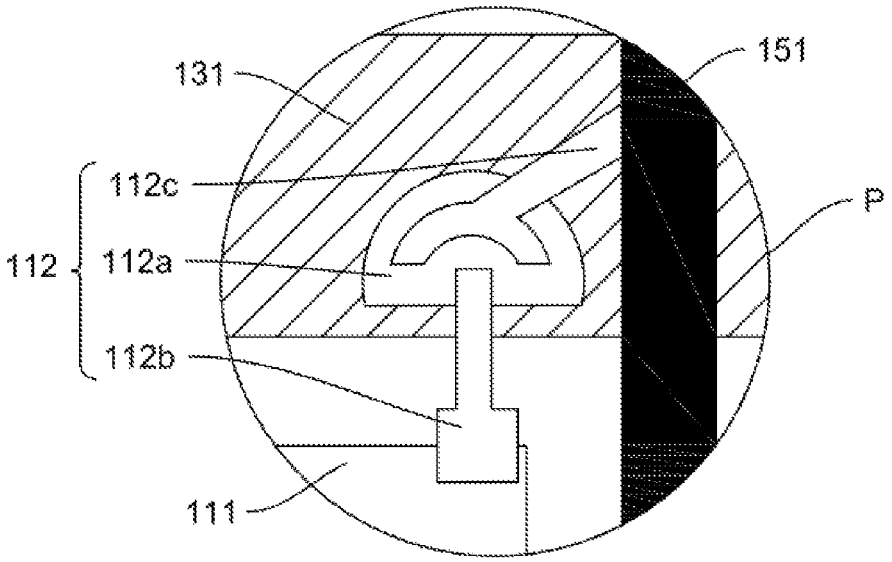
FIG. 1*c* is an enlarged diagram of portion P shown in FIG. 1*a*.

FIG. 1*b* is another structure diagram of the driving circuit according to the exemplary embodiment. FIG. 1*c* is an enlarged diagram of portion P shown in FIG. 1*a*.

Referring to FIG. 1*b*, in the array of the pixel units 11 of the exemplary embodiment, each of the pixel units 11 includes: a pixel electrode 111, a switch component (thin film transistor, TFT) 112, a common electrode wiring 113, and a capacitor (not shown).

Figure 1D:
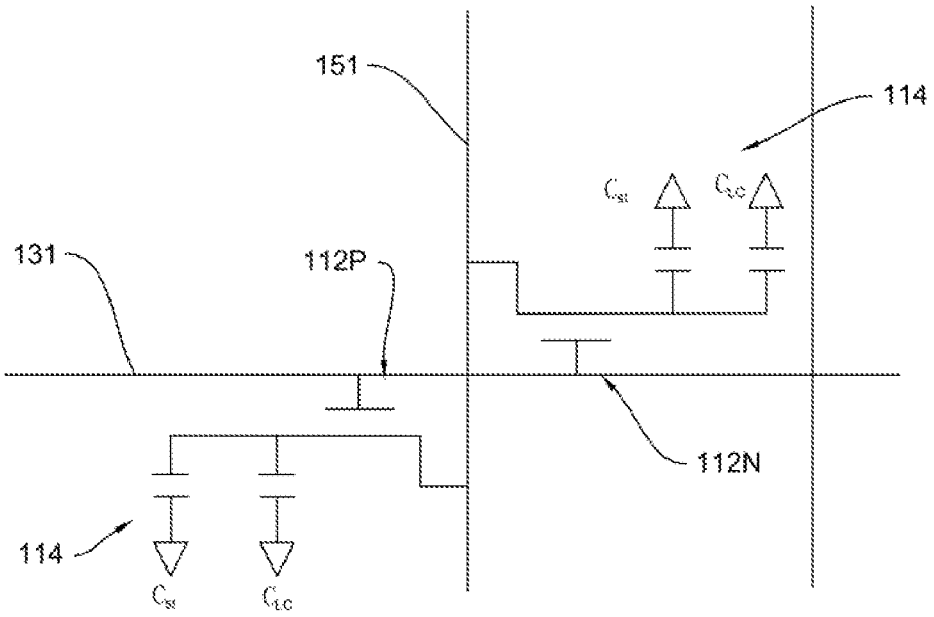
FIG. 1*d* is an equivalent circuit diagram of the driving circuit of the present disclosure according to an exemplary embodiment.

Referring to FIGS. 1*c* and 1*d*, the switch component (TFT) 112 includes: a gate electrode 112*a*, a drain electrode 112*b*, and a source electrode 112*c*, the gate electrode 112*a* is connected with the scan line 131, one of the drain electrode 112*b* and the source electrode 112*c* connects to the data line 151, and the other connects to the pixel electrode 111.

Optionally, in order to make the scan line 131 to control the switch components 112 in different rows by controlling the high and low level, the switch components 112 in different rows can be set to have different conduction types. For example, the switch component 112 of the pixel units 11 in odd row is an n-type thin film transistor 112N, the switch component 112 of the pixel units 11 in even row is a p-type thin film transistor 112P. When the scan line 131 inputs a first driving voltage V1 having positive polarity to the pixel units 11 which are in two rows and connected with the scan line 131, the n-type thin film transistor 112N can be conducted, and the p-type thin film transistor 112P remains as non-conducting state; similarly, when the scan line 131 inputs a second driving voltage V2 having negative polarity to the pixel units 11 which are in two rows and connected with the scan line 131, the p-type thin film transistor 112P can be non-conducting and the n-type thin film transistor 112N remains as non-conducting state. Therefore, one scan line can control the pixel units in two rows to be conducting or non-conducting. Of course, the switch component 112 of the pixel units 11 in even row is set as the n-type thin film transistor, the switch component 112 of the pixel units 11 in odd row is set as the p-type thin film transistor. Then the driving voltages matching with the switch components 112 are adjusted accordingly, thus the aim of the present disclosure can also be realized.

The positive polarity high voltage can be defined as that the first driving voltage V1 is higher than the common voltage $V_{Acom}$ in the pixel unit, and the negative polarity low voltage can be defined as that the second driving voltage V2 is lower than the common voltage $V_{Acom}$ in the pixel unit.

The common electrode wiring 113 faces the pixel electrode 111 to form a storage capacitor Cst. As such the charged voltage can be maintained to the moment of updating image again.

In the pixel unit matrix of the exemplary embodiment, the switch components of the pixel units in two adjacent rows have different types, and the driving voltages of the above switch components have reverse polarities. The pixel units in two adjacent rows can be controlled by controlling the nature of the input driving voltage of one scan line. Therefore, the quantity and occupied space of the scan lines are greatly reduced, and there would remain much more space for the pixel units, and the aperture ratio is also increased. At the condition of the same resolution, the brightness of the present disclosure is effectively improved.

Figure 2:
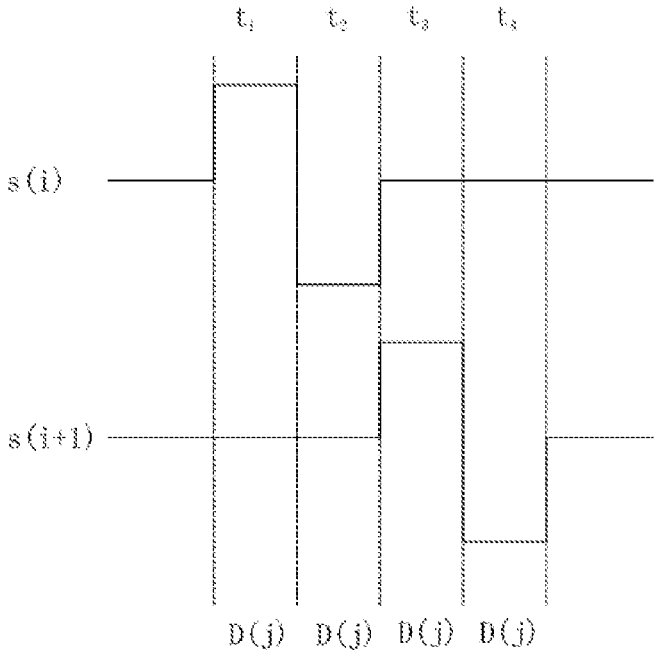
FIG. 2 is a sequence diagram of the scan signal and data signal of the present disclosure according to another exemplary embodiment.

The another exemplary embodiment of the present disclosure provides a driving method for driving circuit, referring to FIG. 2, FIG. 2 is a sequence diagram of the scan signal and data signal applied on the pixel units shown in FIG. 1*a*, the driving method for driving the circuit shown in FIG. 1*a* includes the following steps:

First, the power of the driving circuit is turned on to enable each of the pixel electrodes to be in a power-on state.

Then, under the control of the control unit 17, the scan line s(i) in the scan driver 13 is enabled to input a positive polarity high voltage $V_1$ to the pixel units in row i (for example, a row in odd rows) at a first moment $t_1$, to achieve the conducting of the pixel units which are in row i and connected with the scan line s(i), and i is a positive integer. Optionally, in the exemplary embodiment, the switch component of the pixel units in odd row can be the n-type TFT, when the first driving voltage V1 is higher than the common voltage $V_{Acom}$, the n-type TFT can be turned on. And, the switch component (such as the p-type TFT) which is in row i+1 and connected with scan line s(i) is in the non-conducting state.

At the same time, the data line D(j) in the data driver 15 charges the pixel units in column j, and the charge information is stored in the storage capacitor Cst of the pixel unit in row i and column j, the pixel unit in row i and column j is charged, j is a positive integer.

Furthermore, under the control of the control unit 17, the scan line s(i) in the scan driver 13 is enabled to input a negative polarity low voltage $V_2$ to the pixel units in row i+1 (for example, a row in even rows) at a second moment $t_2$, to achieve the conducting of the pixel units which are in row i+1 and connected with the scan line s(i). Optionally, the switch component of the pixel units in row i+1 can be the p-type TFT, when the second driving voltage V2 is lower than the common voltage $V_{Acom}$, the p-type TFT can be turned on. While at the same time, even if the pixel units in row i and the pixel units in row i+1 all connect to the scan line s(i), as the switch component in the pixel units in row is the n-type TFT, and the first driving voltage V1 and the second driving voltage V2 have reverse polarities, the switch component in the pixel units in row i still remain in the non-conducting state.

And, the data line D(j) in the data driver 15 charges the pixel units in column j, and the charge information is stored in the storage capacitor Cst of the pixel unit in row i+1 and column j, the pixel unit in row i+1 and column j is charged. While the pixel unit in row i and column j remain in the non-conducting state, and cannot be charged through the data line, the original charge information is maintained until updating the image again.

And so forth, the scan line s (i+1) may input the first driving voltage V1 and the second driving voltage V2 at the third moment $t_3$ and the fourth moment $t_4$ respectively under the control of the scan drive. While, the data line D(j) charges the pixel units in column j, and the charge information is stored in the storage capacitor Cst of the pixel unit in row i+2 and column j at the third moment $t_3$, and stored in the storage capacitor Cst of the pixel unit in row i+3 and column j at the fourth moment $t_4$ respectively, as such the pixel unit in row i+2 and column j, and the pixel unit in row i+3 and column j are charged. Therefore, the pixel units in different rows are chosen to be conducted, such the connected pixel units receive the charge information inputted by the data line, and display different images through matching with the backlight source.

For the pixel units in other columns and rows, the driving principle is similar.

In the driving circuit of the exemplary embodiment, the switch components of the pixel units in two adjacent rows have different types, the above switch components also have reverse polarities, the connection and separation of the pixel units in two adjacent rows can be controlled by one scan line. For the driving circuit of the exemplary embodiment, the quantity and occupied space of the scan lines are greatly reduced, and at the condition of the same resolution, the aperture ratio of the pixel units of the present disclosure is greatly improved.

The another exemplary embodiment of the present disclosure provides a liquid crystal display 300, which includes an array substrate 320, a color filter substrate 340 facing the array substrate 320, and a liquid crystal layer (not shown) defined between the array substrate 320 and the color film substrate 340. The array substrate 320 defines a driving circuit 30. In the exemplary embodiment, the array substrate 320 can be a thin film transistor array substrate.

Figure 3A:
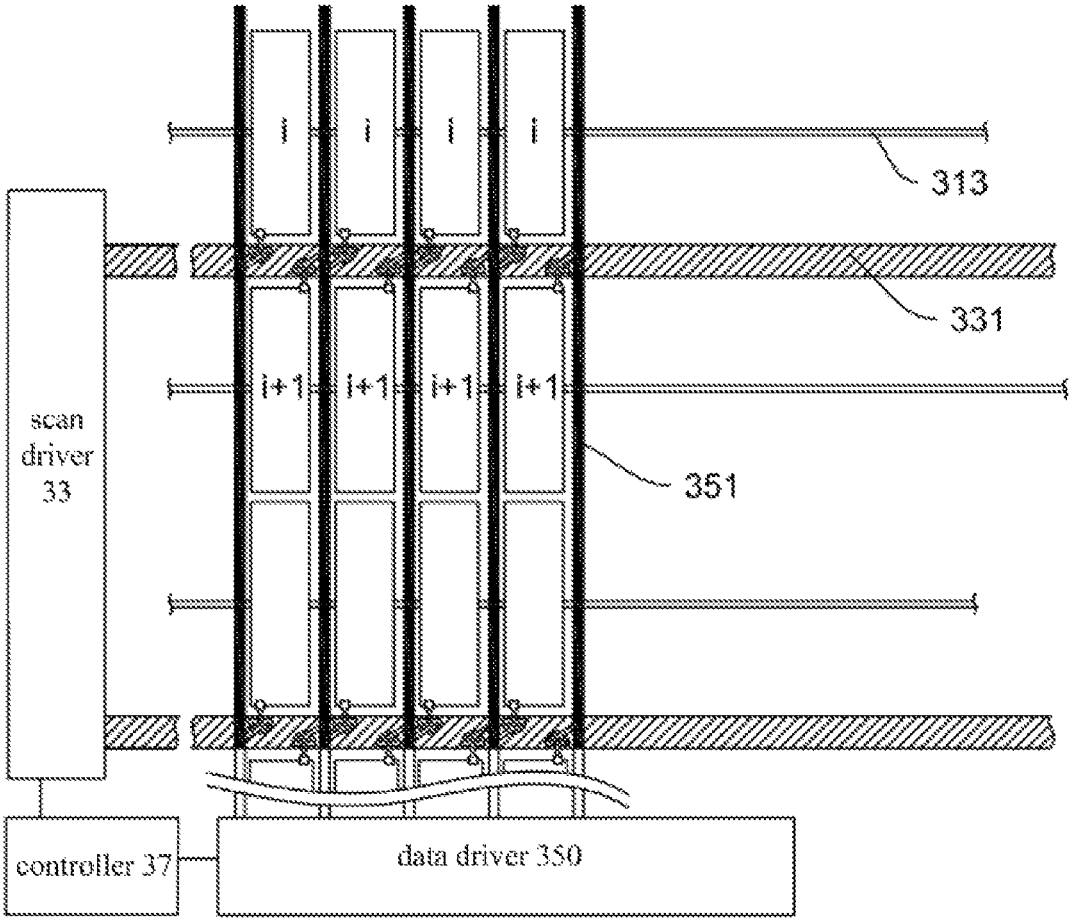
FIG. 3*a* is a structure diagram of the liquid crystal display of the present disclosure according to another exemplary embodiment.
Figure 3B:
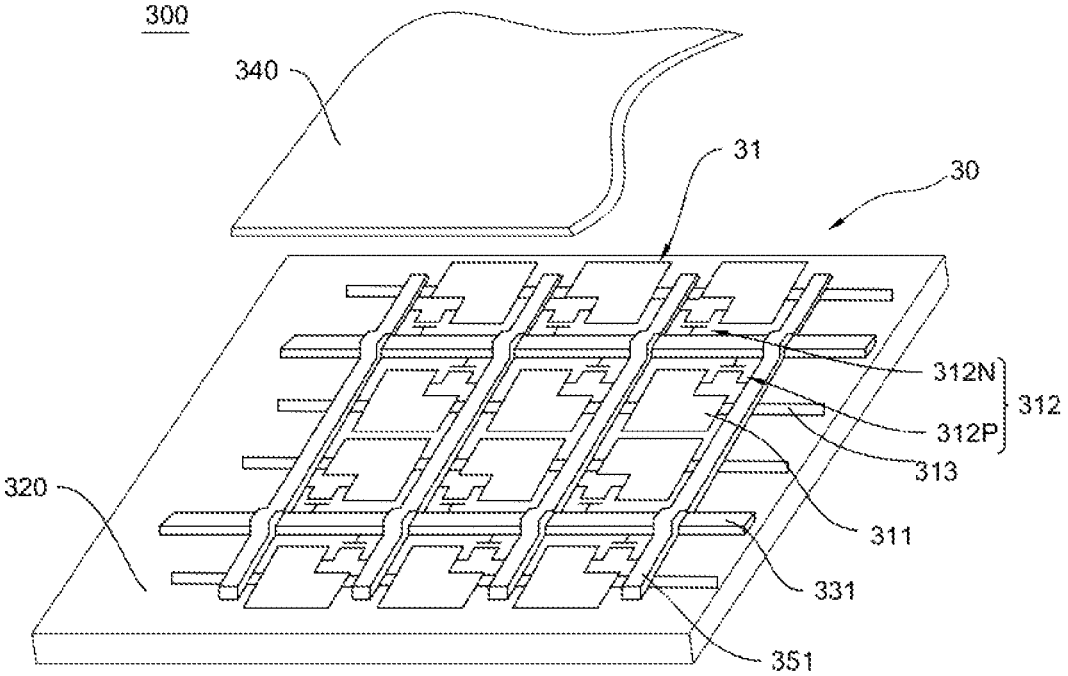
FIG. 3*b* is a structure diagram of the driving circuit of the present disclosure according to another exemplary embodiment.

Referring to FIGS. 3*a* and 3*b*, the driving circuit 30 includes: a plurality of pixel units 31 arranged in matrix; a scan line 331, a data line 351, and a controller 37. The scan line 131 is crossed with the data line 151, the pixel unit 11 is defined at the intersection of the data line 151 and the scan line 131.

The driving circuit 30 of the array substrate 320 is internally provided with a plurality of scan lines 331, for example, the scan lines 331 can be connected to a scan driver 33 to acquire the driving voltage provided by the scan driver 33. For example, the controller 37 may connect to the scan line 331 through the scan driver 33, the scan driver 33 can input a driving voltage with a preset polarity to the scan line 331 at a preset moment.

In the exemplary embodiment, the pixel units 31 in two adjacent rows share one scan line 331, that is, the first pixel units in row i (such as, a row in odd rows), and the second pixel units in row i+1 (such as, a row in even rows) are respectively located at two sides of one scan line 331, and connect to the scan line 331 simultaneously. Optionally, the scan line 331 respectively input a first driving voltage V1 to the first pixel units 31 in row i, and input a second driving voltage V2 to the second pixel units 31 in row i+1, the first driving voltage V1 and the second driving voltage V2 have reverse polarities, the scan line 331 can output different driving voltages at different times, i is a positive integer.

Similarly, the driving circuit 30 of the array substrate 320 is provided with a plurality of data lines 351, for example, the data lines 351 connect to one data driver 35 to acquire the charge information provided by the data driver 35. Each data line 351 connects the pixel units 31 in a corresponding column. For example, the pixel units 31 in the same column may be connected to one same data line 351 alternately and respectively, or the pixel units 31 may also be connected to the same side of the same data line 351. The controller 37 can be connected with the data line 351 through the data driver 35, and input preset charge information to the data line 351 through the data driver 35 at the preset moment.

The controller 37 is connected to the scan line driver 33 and the data line driver 35 to control timing outputs of the scan line driver 33 and the data line driver 35.

Figure 3C:
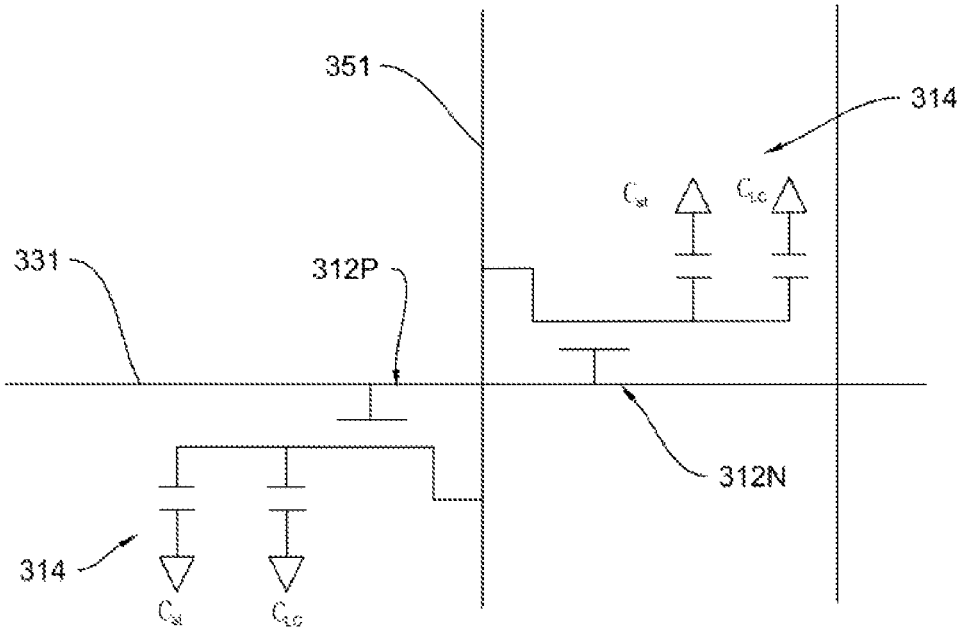
FIG. 3*c* is an equivalent circuit diagram of the driving circuit of the present disclosure according to another exemplary embodiment.

FIG. 3*b* is a structure diagram of the driving circuit. FIG. 3*c* is an equivalent circuit diagram of the driving circuit. Referring to FIGS. 3*b* and 3*c*, in the two-dimensional array of the pixel units of the exemplary embodiment, each of the pixel units 31 includes: a pixel electrode 311, a switch component (thin film transistor, TFT) 312, a common electrode wiring 313, and a capacitor (not shown).

The structure of switch component (TFT) 312 can refer to FIG. 1*c*, the exemplary embodiment does not need to repeat again.

Optionally, in order to make the scan line 331 to control the switch components 312 in different rows by controlling the high and low level, the switch components 312 in different rows can be set to have different conduction types, such the switch states of the switch components 312 are opposite. For example, the switch component 312 of the pixel units 31 in odd row is an n-type thin film transistor 312N, the switch component 312 of the pixel units 31 in i+1 row (such as an even row) is a p-type thin film transistor 312P. When the scan line 331 inputs a first driving voltage V1 having positive polarity to the pixel units 31 which are in two rows and both connected with the scan line 331, the n-type thin film transistor 312N can be conducted, while the p-type thin film transistor 312P remains as non-conducting state; similarly, when the scan line 331 inputs a second driving voltage V2 having negative polarity to the pixel units 31 which are in two rows and both connected with the scan line 331, the p-type thin film transistor 312P can be conducted, while the n-type thin film transistor 312N is in the non-connecting state. Of course, the switch component in the pixel units in even row is set as the n-type thin film transistor, the switch component in the pixel units in odd row is set as the p-type thin film transistor. Then the driving voltages matching with the switch components are adjusted accordingly, thus the aim of the present disclosure can also be realized.

The positive polarity high voltage can be defined as that the first driving voltage V1 is higher than the common voltage $V_{Acom}$ in the pixel unit, and the negative polarity low voltage can be defined as that the second driving voltage V2 is lower than the common voltage $V_{Acom}$ in the pixel unit.

Referring to FIG. 3*c*, the common electrode wiring 313 faces the pixel electrode 311 to form a storage capacitor Cst. As such the charged voltage can be maintained to the moment of updating image for next time.

Liquid crystal molecules (not shown) are filled between the array substrate 320 and the color filter substrate 340. The side of the color filter substrate 340 facing the liquid crystal molecules defines a common electrode layer (not shown), such, in structure, each of the pixel units 31 can be regarded as a layer of liquid crystal molecule between the pixel electrode and the common electrode layer, this structure can be equated as a liquid crystal capacitor $C_{LC}$. In actual application, the liquid crystal capacitor $C_{LC}$ cannot maintain the voltage to the moment that the TFT tube recharges the point and updates the image data again (normally taking a 60 Hz image updating frequency as an example, it needs to maintain about 16 ms). That is, when the TFT tube charges the liquid crystal capacitor $C_{LC}$, the voltage cannot maintain 16 ms. As such, if the voltage changes, the displayed grayscale would be incorrect. Therefore, in the driving circuit, a storage capacitor Cst (for example, Cst can be formed by pixel electrode 311 and the common electrode wiring 313) is added to enable the charged voltage can be maintained to the moment of updating the image again.

In the driving circuit of the liquid crystal display of the exemplary embodiment, the switch components of the pixel units in two adjacent rows have different types, and the driving voltages of the above switch components have reverse polarities. The pixel units in two adjacent rows can be controlled to switch on or switch off by controlling the nature of the input driving voltage of one scan line. Therefore, the quantity and occupied space of the scan lines are greatly reduced, there would remain much more space for the pixel units, and the aperture ratio is also increased. At the condition of the same resolution, the brightness of the present disclosure is effectively improved.

The foregoing descriptions are merely specific implementation manners of the present application, but are not intended to limit the protection scope of the present application. Any variation or replacement readily figured out by a person skilled in the art within the technical scope disclosed in the present application shall fall within the protection scope of the present application.

What is claimed is:

1. A liquid crystal display, comprising an array substrate, a color filter substrate facing the array substrate, and a liquid crystal layer defined between the array substrate and the color film substrate, wherein, the array substrate comprises:

at least one scan line;

at least one data line, crossed with the at least one scan line;

a first pixel unit, defined at an intersection of one of the at least one data line and one of the at least one scan line, the first pixel unit comprising a first pixel electrode and a first switch component, the first pixel electrode being connected to the one of the at least one data line and the one of the at least one scan line through the first switch component;

a second pixel unit, defined at an intersection of one of the at least one data line and one of the at least one scan line, the second pixel unit comprising a second pixel electrode and a second switch component, the second pixel electrode being connected to the one of the at least one data line and the one of the at least one scan line through the second switch component;

wherein, the second pixel unit and the first pixel unit are located at two adjacent rows and share one scan line, and the first switch component and the second switch component have opposite switch states; wherein, the first pixel electrode and the second pixel electrode are respectively located at two opposite sides of the shared scan line, and respectively located at two opposite sides of a same data line; and wherein, the first switch component is an n-type thin film transistor, and the second switch component is a p-type thin film transistor.

2. The liquid crystal display according to claim 1, wherein, the array substrate further comprises a common electrode wiring facing the first pixel electrode and the second pixel electrode to form a storage capacitor.

3. The liquid crystal display according to claim 1, wherein, the array substrate further comprises a common electrode wiring facing the first pixel electrode and the second pixel electrode to form a storage capacitor.

4. The liquid crystal display according to claim 1, wherein, the liquid crystal display further comprises:

a scan line driver, connected to the at least one scan line; and a data line driver, connected to the at least one data line.

5. The liquid crystal display according to claim 4, wherein, the liquid crystal display further comprises a controller, and the controller connects with the at least one scan line driver and the at least one data line driver to control timing outputs of the at least one scan line driver and the at least one data line driver.

* * * * *